US006732952B2

(12) United States Patent
Kah, Jr.

(10) Patent No.: US 6,732,952 B2
(45) Date of Patent: May 11, 2004

(54) OSCILLATING NOZZLE SPRINKLER WITH INTEGRATED ADJUSTABLE ARC, PRECIPITATION RATE, FLOW RATE, AND RANGE OF COVERAGE

(76) Inventor: Carl L. C. Kah, Jr., 11517 Turtle Beach Rd., Lost Tree, North Palm Beach, FL (US) 33408

( * ) Notice: Subject to any disclaimer, the term of this patent is extended or adjusted under 35 U.S.C. 154(b) by 0 days.

(21) Appl. No.: 10/170,061

(22) Filed: Jun. 10, 2002

(65) Prior Publication Data

US 2003/0010842 A1 Jan. 16, 2003

Related U.S. Application Data

(60) Provisional application No. 60/297,120, filed on Jun. 8, 2001.

(51) Int. Cl.[7] ..... B05B 3/00; B05B 3/04

(52) U.S. Cl. ..... 239/225.1; 239/237

(58) Field of Search ..... 239/242, 252, 239/237, 240, 73, 513, DIG. 1

(56) References Cited

U.S. PATENT DOCUMENTS

| | | | | | |
|---|---|---|---|---|---|
| 3,526,363 | A | | 9/1970 | Hauser | |
| 4,579,285 | A | * | 4/1986 | Hunter | 239/457 |
| 4,625,914 | A | | 12/1986 | Sexton et al. | |
| 4,867,378 | A | | 9/1989 | Kah, Jr. | |
| 4,901,924 | A | | 2/1990 | Kah, Jr. | |
| 5,031,840 | A | * | 7/1991 | Grundy et al. | 239/456 |
| 5,086,977 | A | | 2/1992 | Kah, Jr. | |
| 5,098,021 | A | | 3/1992 | Kah, Jr. | |
| 5,148,990 | A | * | 9/1992 | Kah, Jr. | 239/222.17 |
| 5,417,370 | A | | 5/1995 | Kah, Jr. | |
| 5,588,594 | A | * | 12/1996 | Kah, Jr. | 239/107 |
| 6,237,862 | B1 | | 5/2001 | Kah, III et al. | |
| 2002/0130202 | A1 | * | 9/2002 | Kah, Jr. et al. | 239/514 |
| 2002/0166900 | A1 | * | 11/2002 | Sesser et al. | 239/204 |
| 2003/0075620 | A1 | * | 4/2003 | Kah, Jr. | 239/553 |

* cited by examiner

*Primary Examiner*—Eduardo C. Robert
*Assistant Examiner*—Anu Ramana
(74) *Attorney, Agent, or Firm*—Ostrolenk, Faber, Gerb & Soffen, LLP

(57) ABSTRACT

An oscillating nozzle sprinkler for directing an adjustable flow of water therefrom at adjustable desired range and arc of coverage and at a pre-settable precipitation rate. The desired flow rate or precipitation rate for a particular arc of coverage can be selected and the flow will then be automatically varied as the arc of sprinkler oscillation is adjusted to maintain the precipitation rate that was set. The nozzle discharge range is adjustable from the top with integrated flow control to automatically maintain the precipitation rate that was set constant as the range is changed for a smaller area of coverage due to the reduced range.

41 Claims, 8 Drawing Sheets

OSCILLATING NOZZLE SPRINKLER WITH INTEGRATED ADJUSTABLE ARC, PRECIPITATION RATE, FLOW RATE, AND RANGE OF COVERAGE

FIELD OF THE INVENTION

This invention relates to oscillating nozzle sprinklers which are adjustable to select different arcs of coverage with an integrated selectable precipitation rate, flow rate and range of coverage.

BACKGROUND OF THE INVENTION

In U.S. Pat. Nos. 4,867,378 and 4,901,924 sprinklers are disclosed that have adjustable arcs of oscillation and an indicator on the top of the nozzle that displays the selected arc angle. In U.S. Pat. No. 5,417,370 a reversing gear drive with settable arc of oscillation is disclosed. These patents illustrate several drive mechanisms for oscillating sprinklers in which the arc-of-coverage is easily adjustable, and which provide an indication of the selected arc angle on the top of the nozzle. Other types of drive mechanisms such as ball drives and reversing turbine gear drives can also be used in such sprinklers.

In U.S. Pat. No. 5,098,021 an oscillating nozzle sprinkler with integrated adjustability of both arc of coverage and flow is disclosed. In this patent, the selected flow rate (or the corresponding precipitation rate) is displayed on the top of the nozzle separately from the selected arc setting. This patent also discloses a nozzle configuration with an adjustable throat plug for changing the flow rate through the nozzle and various configuration for providing different water distribution patterns.

In U.S. Pat. No. 5,086,977, an oscillating water driven sprinkler is disclosed having a nozzle in which the stream elevation angle or spray range is adjustable from the top surface of the nozzle using a screw mechanism.

In U.S. Pat. No. 6,237,862, a nozzle configuration is shown in which the nozzle tube is surrounded by and attached to a flexible thin diaphragm. The shape of the diaphragm allows the nozzle tube to be effectively hinged so that deflecting the nozzle tube establishes a desired sprinkler steam exit angle.

Above-mentioned U.S. Pat. Nos. 4,867,378, 4,901,924, 5,417,370, 5,098,021, and 6,237,862 provide general, technical background, and further physical and mechanical background for the features and improvements of this invention, and are incorporated by reference herein as if fully disclosed.

None of these patents, however, nor any other sprinklers known to applicant, provide the capability for automatic adjustment of the flow to maintain a preset precipitation rate as the spray range and/or arc of coverage is adjusted. In some instances, stream break-up screws have been provided, but there has been no way to maintain a constant precipitation rate if a pre-selected spray range or arc of coverage was changed in the field, or even to know how the precipitation rate was affected by such changes without performing a laborious calculation from catch cup data, which was rarely done in practice.

The installer may need to adjust the ranges and arc angles of some or all of the sprinklers at the time of installation. Since it is important that the precipitation rates of individual sprinklers or groups of sprinklers be known and matched for uniform precipitation, and the flow for a given precipitation rate varies with the spray range and arc angle, nozzles of different flow rates and for different rangess of coverage must be available. It has thus been customary to install different nozzles at different locations in complex layouts in order to achieve reasonably uniform precipitation.

A need clearly exists for a sprinkler in which the arc angle, spray range, and precipitation rate are adjustable, and in which a desired precipitation rate can be set and maintained by automatic changes in the flow rate as adjustments of the arc angle and spray range are made by the user.

SUMMARY OF THE INVENTION

It is accordingly an object of this invention to provide an oscillating nozzle sprinkler in which the arc angle and precipitation rate are adjustable, and in which a desired precipitation rate can be set and maintained by automatic changes in the flow rate as adjustments of the arc angle are made by the user.

It is also an object of this invention to provide an oscillating nozzle sprinkler in which the spray range and precipitation rate are adjustable, and in which a desired precipitation rate can be set and maintained by automatic changes in the flow rate as adjustments of the spray range are made by the user.

It is a further object of this invention to provide an oscillating nozzle sprinkler in which the arc angle, spray range, and precipitation rate are adjustable, and in which a desired precipitation rate can be set and maintained by automatic changes in the flow rate as adjustments of the arc angle and spray range are made by the user.

It is an object of this invention to provide oscillating nozzle sprinklers as described above in which adjustments can be made from the top of the nozzle.

It is a related object of this invention to provide oscillating nozzle sprinklers as described above in which indicators are provided on the top of the nozzle to show the selected settings for the arc angle, the spray range and the precipitation rate.

These objects are achieved by coupling an adjustable flow control mechanism to separate independently adjustable spray range and arc control mechanisms. Rotatable members representing each of these functions are provided on the top of the sprinkler nozzle housing so that they may be set relative to each other on a precipitation rate scale located between the rotatable members.

Now the flow rate can be set relative to the arc and to the maximum spray range to provide a desired precipitation rate, and if the arc angle is increased or decreased, the flow automatically increases or decreases to compensate for the change and to maintain the preset relative precipitation rate. Similarly, if the spray range is reduced from its maximum value, the flow is correspondingly decreases so that, again, the precipitation rate does not change.

Thus, with the sprinkler according to this invention, a preset relative known precipitation rate can be maintained for all arc settings and ranges of coverage, and complex calculations and field adjustments of flow rate can be avoided.

The indication on the top of the sprinkler will allow all of the sprinklers used in a particular irrigation zone which all run at the same time at approximately the same pressure to be correctly set relative to each other. While the exact numbers as indicated will vary as the square root of the pressure from that of the sprinkler's design normal pressure. However, these differences are small unless pressure is greatly different from design and the sprinklers will all be performing relative to each other for that irrigation zone where they are all turned on and off together.

Different scales can even be provided for high pressure or low pressure sprinklers.

Likewise, the installer can set sprinklers operating in groups relative to each other for the same precipitation (matched precipitation) which is what is most important and sprinklers whose range must be shortened will then flow the correct amount of water without having to change nozzles.

Other features and advantages of the present invention will become apparent from the following description of the invention which refers to the accompanying drawings.

BRIEF DESCRIPTION OF THE DRAWING(S)

FIG. 1 is a cross-sectional side elevation view of a rotatable sprinkler nozzle assembly, with the nozzle housing assembly mounted on a partially sectioned riser assembly showing the rotatable nozzle assembly drive shaft arrangement and the significant components of the arc set, nozzle flow control, precipitation rate setting and nozzle range adjustment mechanism. The nozzle flow throttling member is shown in the full open position.

DETAILED DESCRIPTION OF EMBODIMENTS OF THE INVENTION

Figure 1:
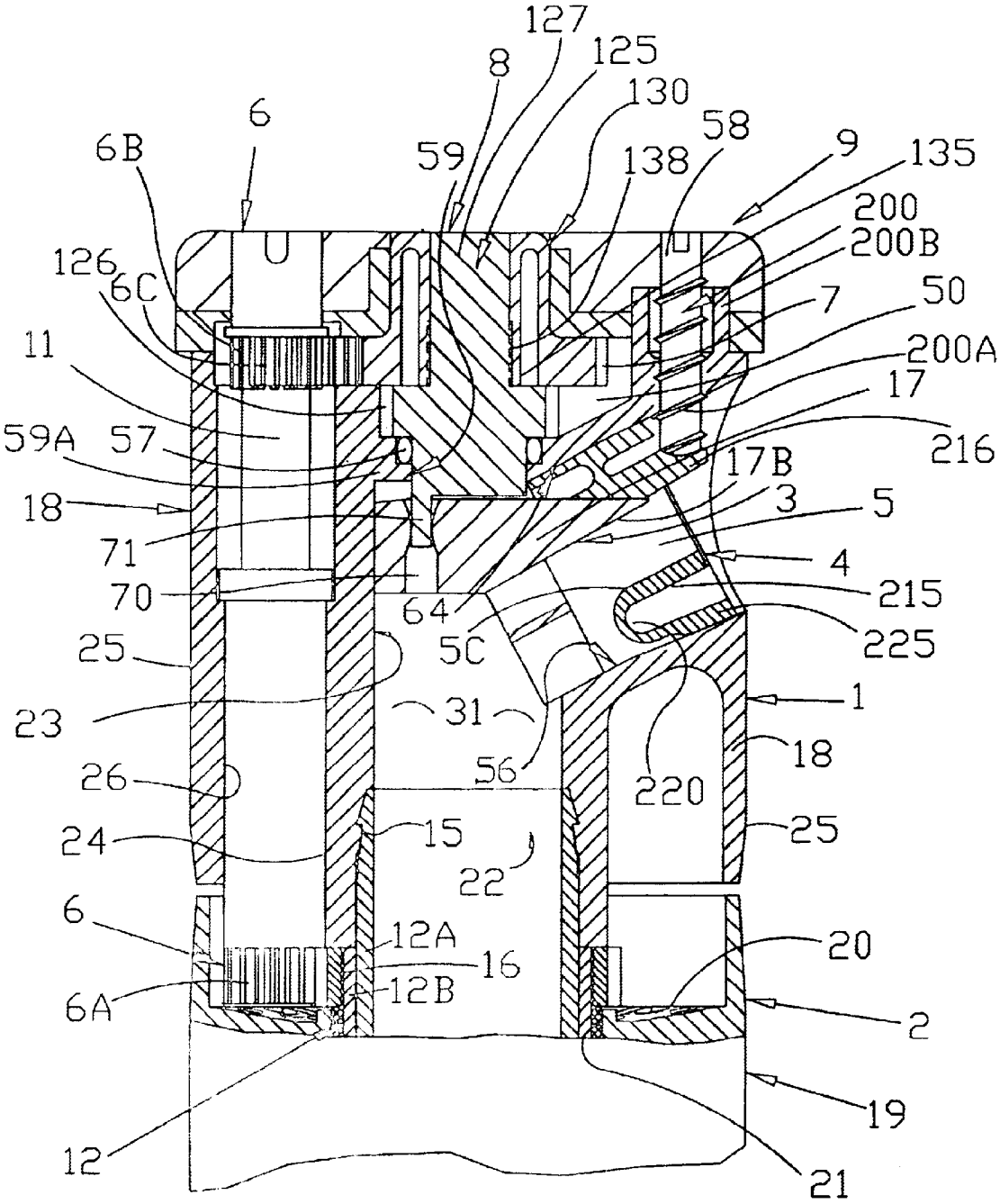

Referring to FIG. 1, a rotatable sprinkler nozzle assembly 1 is shown mounted on a cylindrical riser assembly 2 which includes a suitable rotary drive mechanism (not shown) for driving sprinkler nozzle assembly 1.

Details of arc-settable oscillating rotary-drive sprinklers of the type shown in FIG. 1 are set forth in U.S. Pat. Nos. 5,417,370, 4,901,924 and 4,867,378, incorporated herein by reference above. However, this invention is applicable to any arc-settable rotary-drive sprinkler including reversing gear or reversing turbine or ball drive mechanisms shown in U.S. Pat. Nos. 3,526,363 and 4,625,914, for example.

Riser assembly 2 includes a housing 19 with a top cover 20. An opening 21 at the center of cover 20 receives a hollow rotatable output nozzle drive shaft 12 including concentric hollow tubular portions 12A and 121B extending from the drive mechanism. Water from a supply (not shown) is directed to through the interior 22 of tubular portion 12A into the rotatable sprinkler nozzle assembly 1.

The rotatable sprinkler nozzle assembly 1 is comprised of the following main parts; a nozzle housing 18, a nozzle 4, a nozzle flow throttling member 3, and an adjustable arc setting device 6 including rotatable arc setting shaft 11 for setting the arc of oscillation of the drive assembly, a flow setting and indicating assembly generally denoted at 8 including two concentric shafts 125 and 130 whose top surfaces and relative rotational position indicate the precipitation rate that has been set, and a range adjustment mechanism generally denoted at 9.

The nozzle housing 18 has an outer wall 25 of approximately the same outside diameter as riser assembly 2, and a tubular structure 23 which defines a central cavity 31. Outwardly spaced from cavity 31 is a passage 26 which receives arc setting shaft 11. A downward extension 24 of tubular structure 23 terminates just below the bottom edge of outer wall 25 of the nozzle housing 18, and receives the hollow inner tubular portion 12A of drive shaft 12. Tubular portion 12A is secured in downward extension 24 by a snapping step at 15.

A gear 6A at the lower end of arc setting shaft 11 engages with a complimentary gear 16 on an outer nozzle drive shaft portion 12B. Gear 16 rotates outer nozzle drive shaft 12B which, in turn, move one of the arc control contact members (not shown) of the oscillating drive mechanism housed in the riser housing 19. A second arc control contact (also not shown) is connected to an inner drive shaft portion 12A.

The arc-settable rotational dove including the two control contacts is shown and described in the aforementioned U.S. patents incorporated by reference above, and in patents such as Hauser U.S. Pat. Nos. 3,526,363 and 3,645,451 which include reversing turbine configurations.

Figure 6:
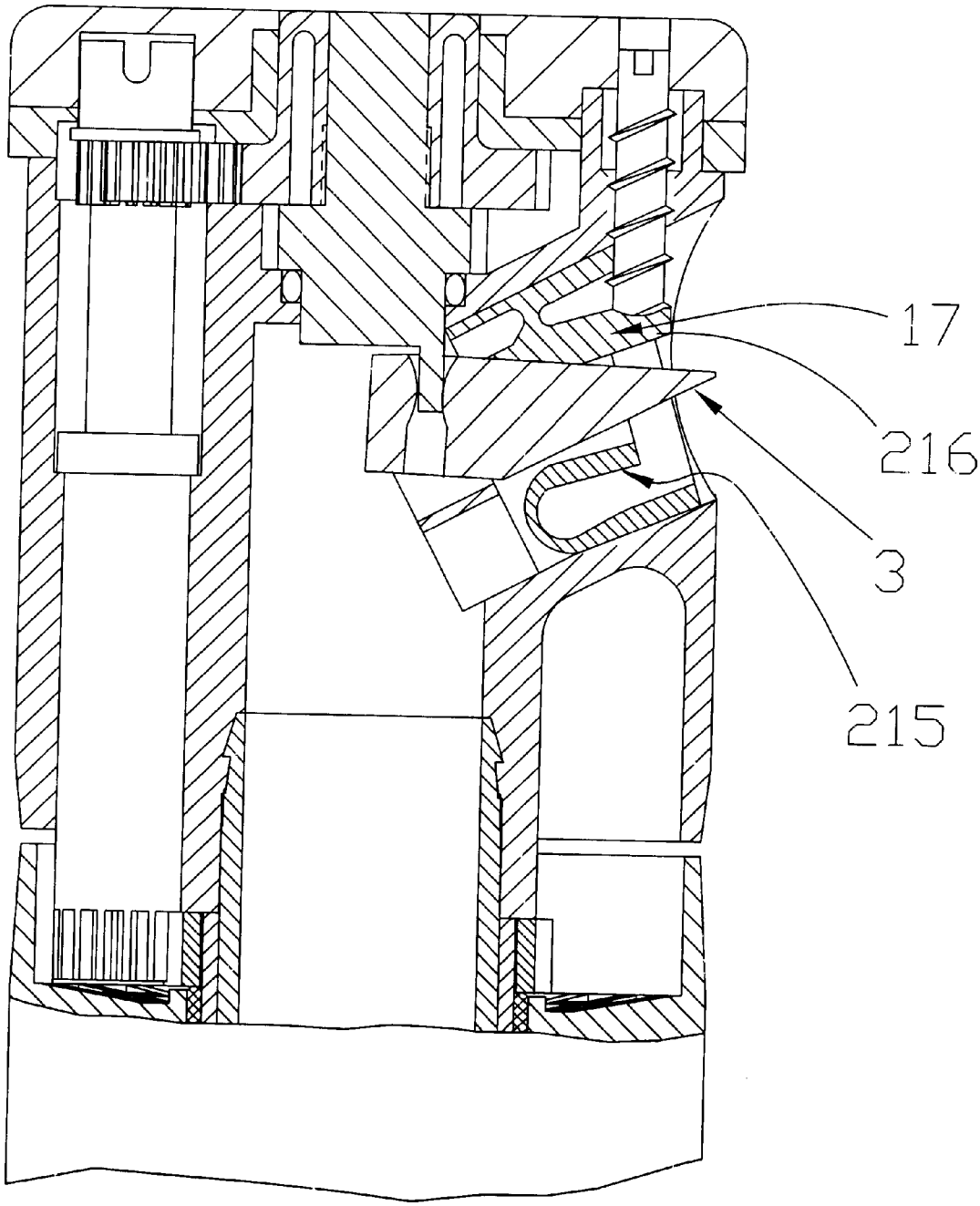
FIG. 6 shows the nozzle housing assembly of FIG. 4 with the range control screw turned full down to cause the nozzle tube to be rocked and further throttling the nozzle throat flow for the now reduced area of coverage.
Figure 7A:
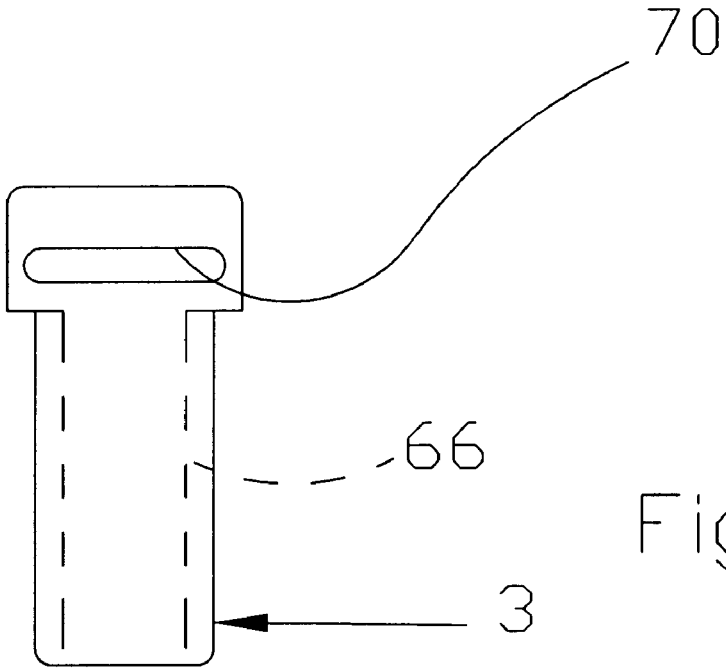
FIG. 7A is a top view of the nozzle throat throttling member.
Figure 7B:
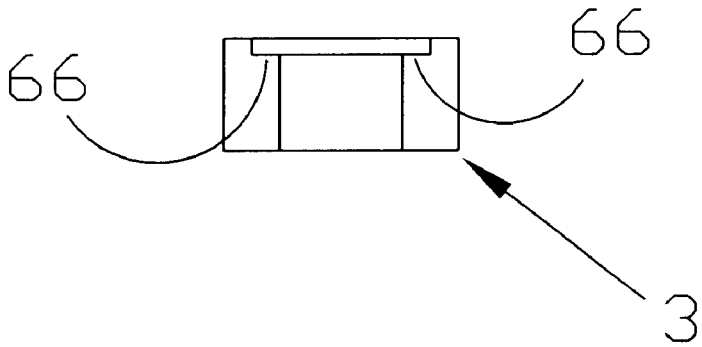
FIG. 7B is an end elevation of the throttling member.

Precipitation rate is a volume per unit time (gallons per minute) applied over a particular area. Thus, if the arc of coverage is changed or the range of coverage is changed the flow rate must be changed to maintain the same precipitation rate. To provide the necessary coupling between the arc setting and the flow rate, a second gear 6B at the upper end of shaft 11 engages with a complementary gear 7 on shaft 130 through an intermediate gear 6C, as described below. The coupling between the range adjustment and the flow rate is provided by the action of the inner surface 56 of nozzle 4 and the surface 17B of the nozzle throttling member 3 as the nozzle 4 is deflected downwardly by the action of range adjustment screw 200 as shown in FIG. 6.

A cylindrical passage 64 extends from the top portion of central cavity 31 in the nozzle housing 18, to the outside wall 25 at an upwardly sloped angle of, for example, 25 to 27 degrees for receiving the nozzle 4.

The top of central cavity 31 communicates with an upper cavity 50 within which the rotational elements of the flow control and the connecting gearing are mounted.

Rotatable shaft 125 of flow control mechanism 8 includes an off centered crank pin 71 at its lower end. This fits into a camming slot 70 in flow throttling member 3. Pin 71 and slot 70 cooperate to move the flow throttling member 3 in and out of the throat area 5 of the nozzle 4, thereby to vary the nozzle flow area. The lower end 59 of shaft 125 is sized to be fitted into stepped throat portion 59A at the top of central tubular structure 23, and is sealed by an "O" ring 57.

Figure 2:
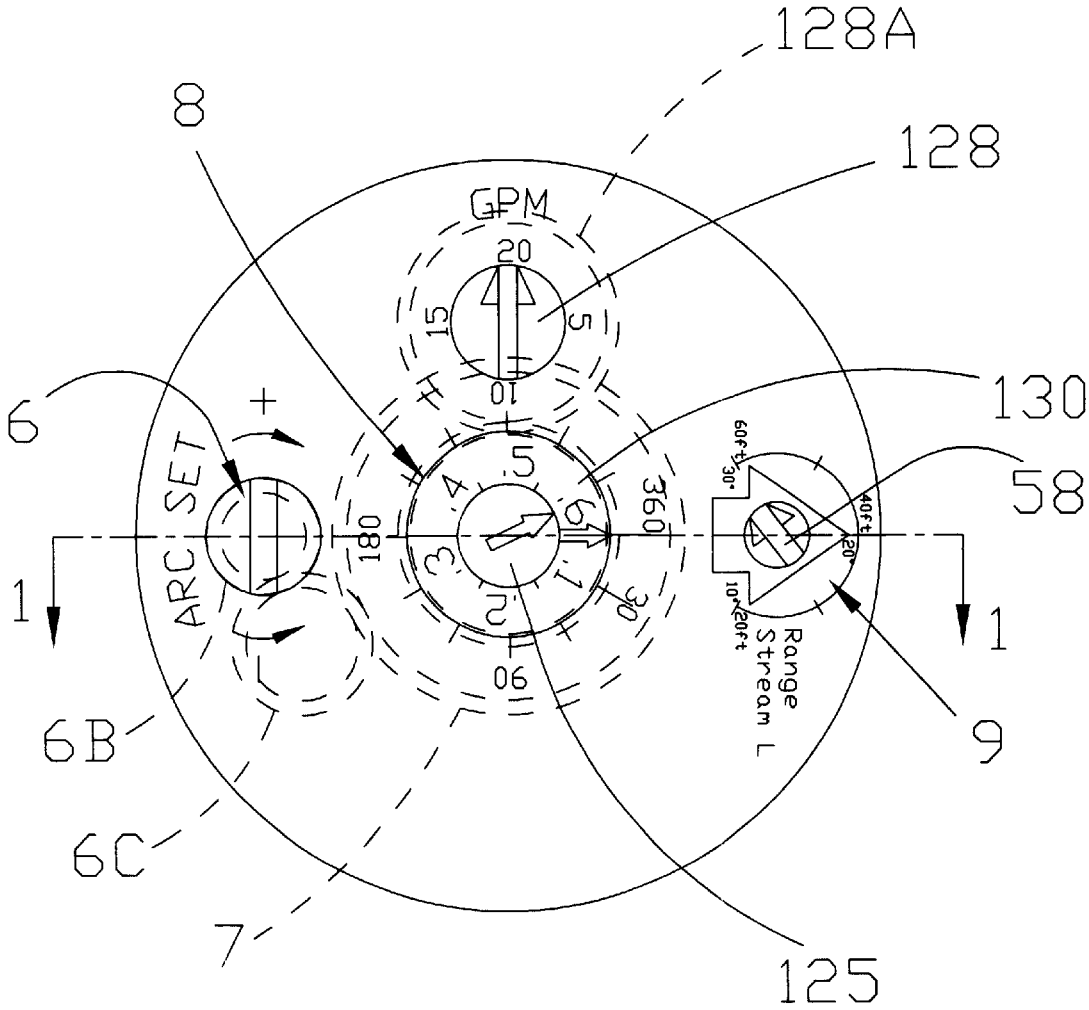
FIG. 2 is a top view of the nozzle assembly housing of FIG. 1 showing the location of the adjustments and flow rate, precipitation rate, arc set angle and range indicators.
Figure 3:
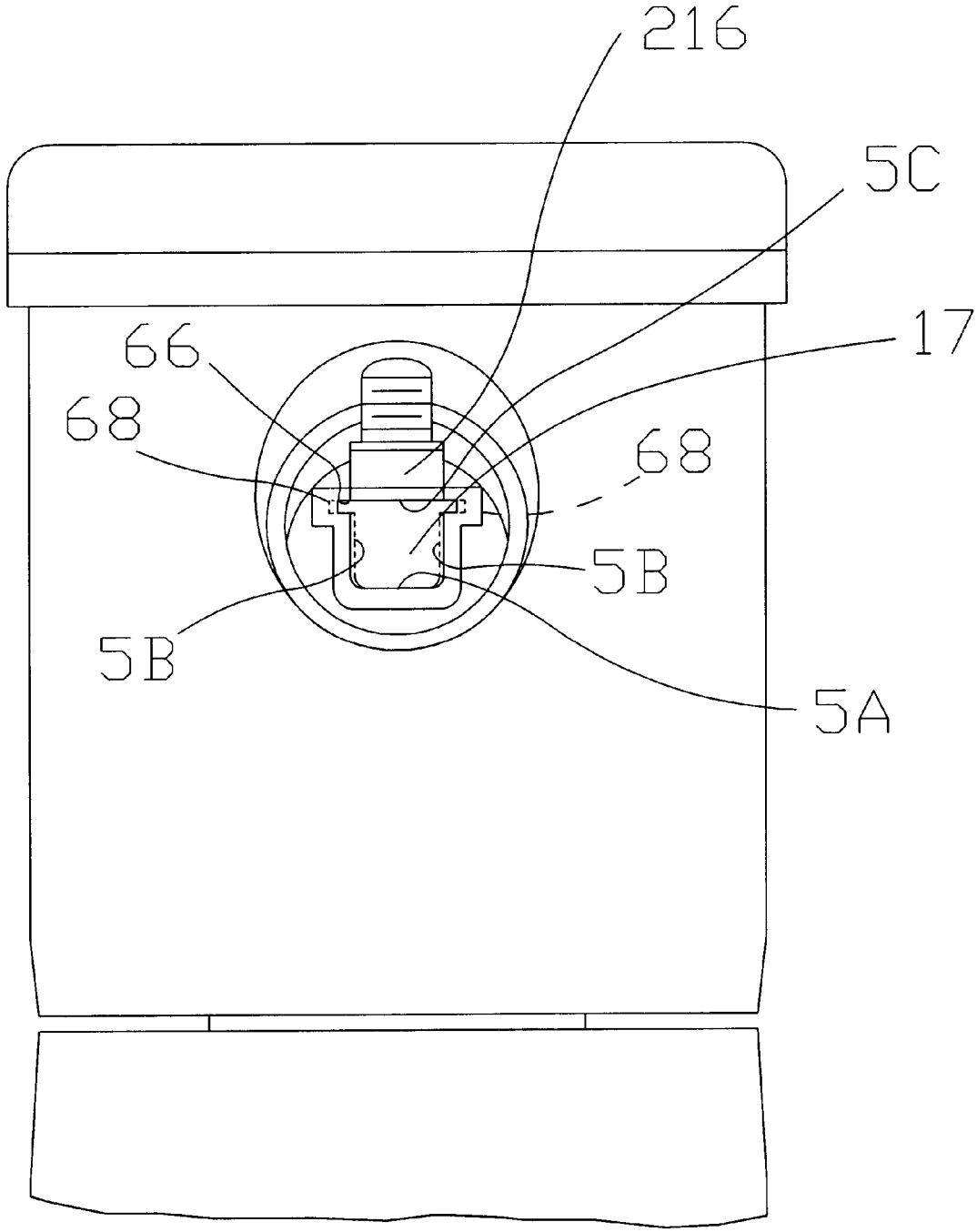
FIG. 3 is a side elevation view of the nozzle housing assembly showing the adjustable flow area nozzle in place.
Figure 4:
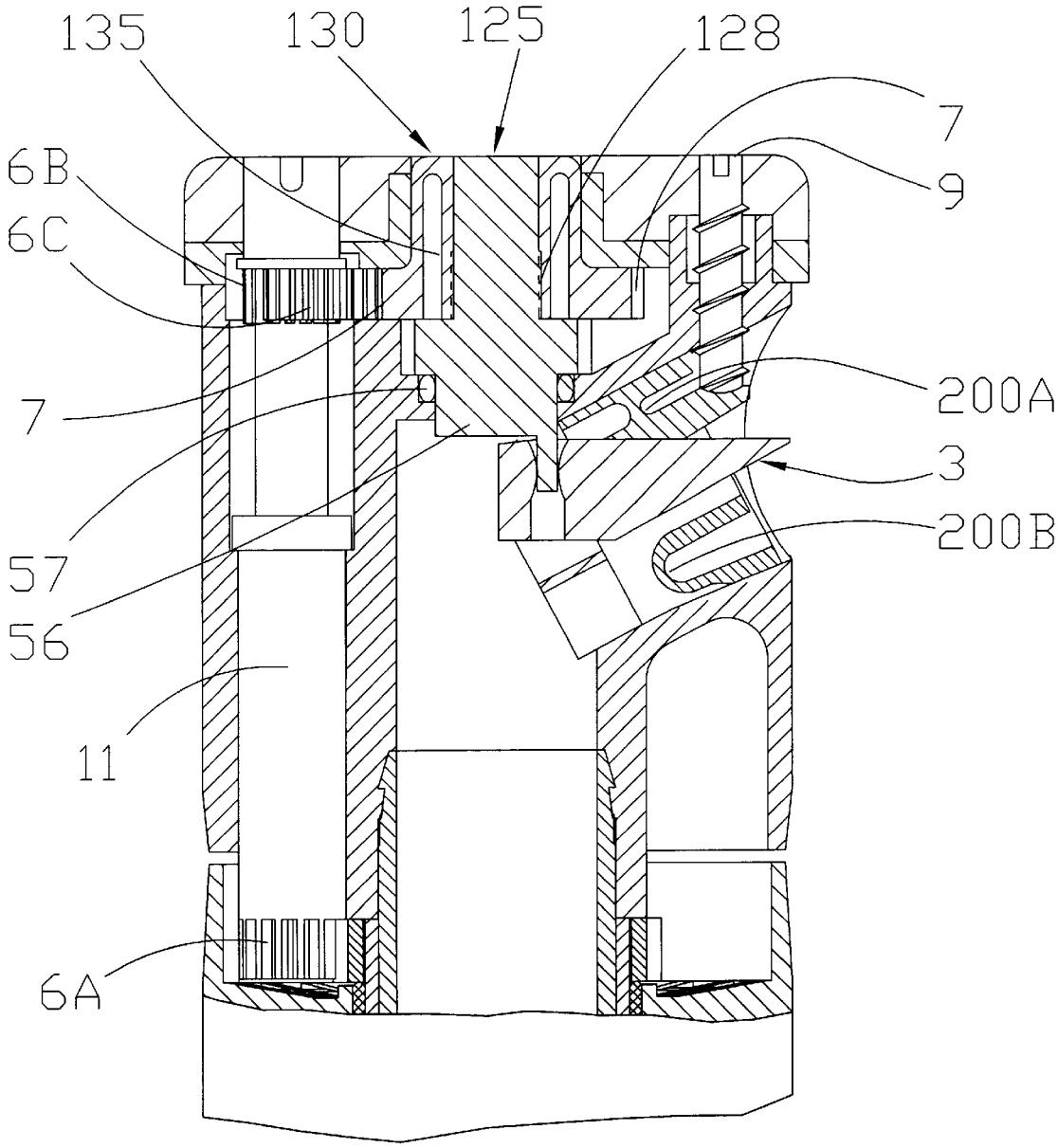
FIG. 4 shows the nozzle assembly of FIG. 1 with the nozzle flow throttling member shown in the full throttle position for the nozzle stream tube angle as shown.

FIG. 1 shows pin 71 in the position corresponding to the maximum retracted position for throat plug 3, i.e., corresponding to maximum flow for the full range setting as described in detail below. By way of comparison, FIG. 4 shows pin 71 in the position corresponding to the maximum extended position for throat plug 3, i.e., corresponding to minimum flow for the full range setting Shaft 125 includes a serrated portion or a gear denoted at 126 which engages with another serrated portion or gear 128A on a second radially spaced rotatable shaft 128 which rotationally couples shaft 125 and shaft 128, as shown in FIGS. 1 and 2. Since crank pin 71 on shaft 125 moves throttling member 3, the rotational position of shaft 125 determines the flow rate through the sprinkler. The rotational coupling of shaft 125 and shaft 128 thus permits shaft 128 to be employed to set and/or indicate the flow rate.

Shaft 125 has an upper shaft portion 127 extending to the top of the sprinkler nozzle housing which can also be used for setting and/or indicating the flow control shaft position. Upper shaft portion 127 is coupled by serrations 138 to a concentric arc set indicator shaft 130. Rotation of arc set indicator shaft 130 thus rotates flow control shaft 125. Arc set indicator shaft 130 includes a thin silted cylindrical wall section 135. This cooperates with serrations 138 to provide a frictional clutch mechanism which allows shaft 125 to be rotated separately from shaft 130.

The arc of coverage setting made by adjustment of mechanism 6 as previously described, is maintained by friction resulting from the fit of shaft 11 in nozzle housing 18, and the fit of concentric tubular portions 12A and 12B.

This friction is made to be greater than that to rotationally set the flow control shaft 125 so that the flaw can be adjusted without changing the arc set shaft position. Likewise, rotation of shaft 11 will carry shaft 125. Since the position of shaft 125 determines the flow as described below, the flow automatically changes from a preset value as the arc of oscillation is adjusted. Thus, the relationship of flow to the arc of oscillation, i.e., the relative precipitation rate for the sprinkler, which determines how much water is put down per unit of area being covered by the set oscillation of the nozzle, can be maintained substantially unchanged. Similarly, the rotational relationship between shafts 127 and 130 can be used to provide an approximate precipitation rate indication for the sprinkler as shown on the sprinkler top in FIG. 2, and can be an exact precipitation rate at a particular selected nominal sprinkler supply pressure and nozzle stream angle (range).

As shown in FIGS. 1, 3, 7A and 7B, nozzle 4 includes a primary flow opening nozzle throat 5 with its lower end formed as a semi-circle 5A or flat. A rectangular opening 5B extending upwardly from the lower end of threat 5 to receive a rectangular plug 17 of flow throttling member 3 which extends substantially parallel to the axis of cylindrical opening 64 along the upper side of nozzle flow throttling member 3. Rectangular opening 5B extends upwardly to a straight surface 5C which, in turn, extends through fixed nozzle 4 from the front end to the rear end thereof.

Guide ribs 66 to each side of throttle adjusting plug 17 vertically position the throttling member 3 in grooves 68 in the nozzle 4. These ribs 66 on either side of plug 17 maybe used to throttle the secondary near field spray flow of the nozzle as described for the throttling nozzle of the above-referenced U.S. Pat. No. 5,098,021.

The range setting mechanism 9 and the manner in which it is coupled to the flow control mechanism 8 will now be described. As previously noted, such coupling permits the flow rate for a preset full range precipitation rate to vary with the stream exit elevation angle so that the precipitation rate remains approximately the same as the range of coverage is varied.

The range adjusting mechanism 9 comprises a range control shaft 200 which may include a slotted head 58 accessible at the top of the nozzle as shown in FIGS. 1 and 2. Shaft 200 includes a threaded portion 200A extending along its length, which engages with a complementary threaded portion 200B in nozzle housing 18 whereby shaft 200 moves up and down into the nozzle opening 64 as slotted head 58 is rotated.

The lower end of shaft 200 engages with a leg portion 216 at top side of the outer end of nozzle 4. As shown in FIGS. 1 and 6, as shaft 200 moves down, it deflects leg 216 downward. This in turn, downwardly deflects nozzle tube 215, and also flow control plug 17. This movement is allowed and controlled by the hinge action of the thinned diaphragm area 220 that surrounds the nozzle tube 215. The movement of plug 17, in turn, causes a nozzle tube 215 located inside the bottom portion of the throat area 5C to be rocked backwardly and upwardly because of the reduced diaphragm area over the top as shown a 220A and the greater diaphragm radius at the bottom as shown at 220B in FIG. 6.

As can be seen in FIG. 6, as the nozzle tube 215 is rocked downwardly, the clearance between the inside bottom portion of throat area 5C and throttling member surface 17B is reduced. This reduces the flow area, and maintains the preset full range precipitation rate as range is reduced. The flow control mechanism itself is described more fully in the above-mentioned U.S. Pat. No. 5,098,021 incorporated herein by reference.

Although a specific embodiment has been described, other embodiments and variations a possible within the scope of the invention. For example, moving the nozzle tube 215 downwardly can also be used to throttle the secondary spray flow of slot 68, as described fully in the above-mentioned U.S. patents incorporated herein by reference.

Figure 5:
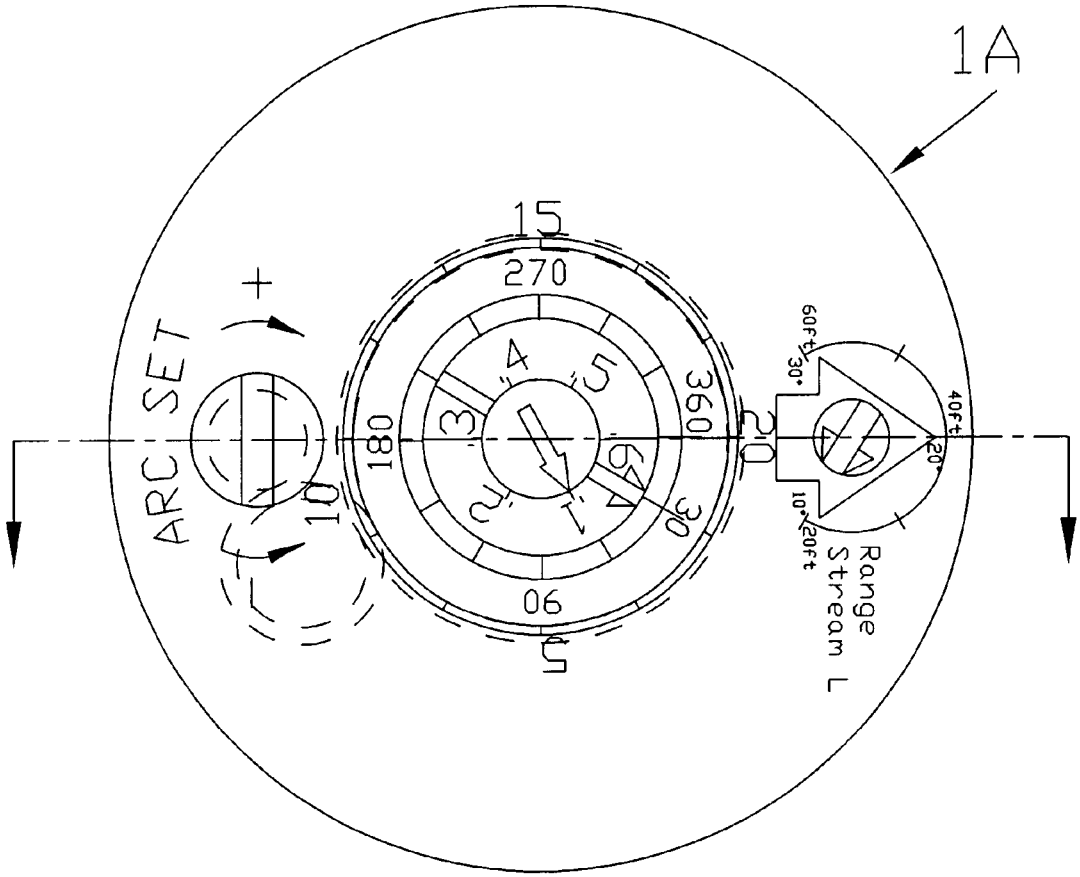
FIG. 5 is a top view of a modified nozzle assembly having a different flow adjustment and indicator layout from that of FIG. 2.

Also, the indicator configuration as illustrated in FIG. 2 can be modified. As an example, FIG. 5 illustrates a top view of a nozzle assembly 1A in which a separate flow indicator is not employed. Instead, the flow setting shaft is incorporated into the center flow and precipitation indicator shaft.

Figure 8:
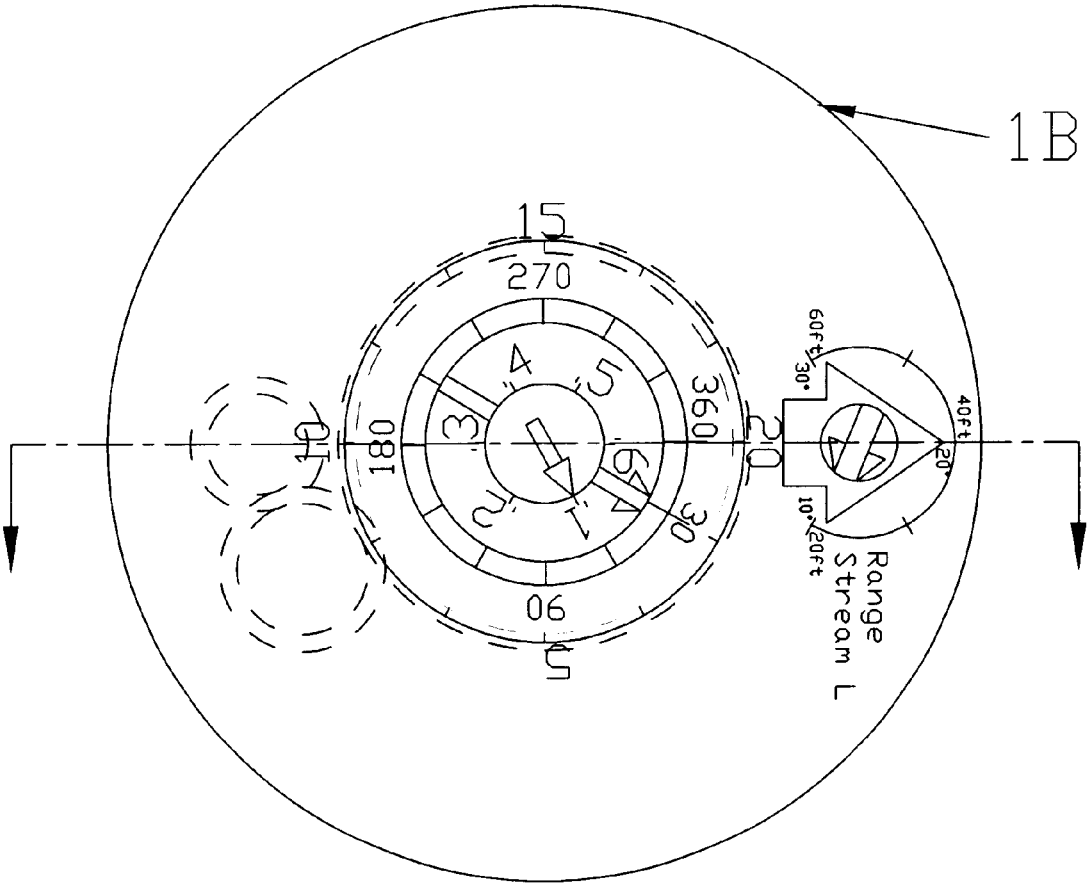
FIG. 8 is a top view of a further modification of the nozzle adjustment and indicting mechanisms.

Similarly, FIG. 8 shows a top view of a nozzle assembly 1B in which the separate arc setting shaft has been eliminated from the top and the arc set, precipitation rate settings and indications are provided by only the two center flow and arc connected shafts.

In this connection, in the configurations described, the flow rate indicator is coupled only to the arc setting mechanism, and not to the range setting mechanism. Thus, compensating change in the flow rate as the arc of oscillation is adjusted are indicated, but changes in flow rate as the range is adjusted are not shown. By providing coupling between the range adjusting mechanism 9 and the flow indicator, flow changes with range adjustment can also be indicated in the configurations of FIGS. 2, 5, and 8.

Moreover, while there has been disclosed as a single nozzle configuration with a rectangular moving plug to vary flow nozzle as the range is adjusted, other configurations can be envisioned which will provide coupling between the flow for a preset full range precipitation rate and the range adjustment.

Although the present invention has been described in relation to particular embodiments thereof, many other variations and modifications and other uses will become apparent to those skilled in the art. It is intended, therefore, that the present invention be limited not by the specific disclosure herein, but only by the appended claims.

What is claimed is:

1. A sprinkler comprising:

a nozzle;

a spray range setting mechanism that is manually adjustable to set a desired elevation angle at which a stream of water exits from the nozzle;

a flow control mechanism that is manually adjustable to vary the precipitation rate for the sprinkler; and a coupling mechanism between the spray range setting mechanism and the flow control mechanism which automatically adjusts the flow rate when the spray range setting mechanism is adjusted to maintain a substantially constant precipitation rate independent of changes in the spray range while permitting independent adjustment of the flow control mechanism without disturbing an existing spray range setting.

2. A sprinkler as described in claim 1, wherein the coupling mechanism is constructed to permit relative movement between the flow control mechanism and the spray range setting mechanism when the flow control mechanism is operated whereby the flow may be adjusted to change the precipitation rate without disturbing the existing spray range setting.

3. A sprinkler as described in claim 1, wherein the spray range setting mechanism is comprised of an adjustable range setting actuator mechanism coupled to a deflectable portion of the nozzle, the deflectable portion of the nozzle being constructed to set the exit angle of water flowing from the nozzle according to the adjustment of the actuator mechanism.

4. A sprinkler as described in claim 3, wherein the actuator mechanism is a rotatable threaded shaft which moves linearly to pivot the deflectable portion of the nozzle.

5. A sprinkler as described in claim 3, wherein the flow control mechanism includes a flow control element movable in the nozzle flow path, and a flow control actuator mechanism which adjusts the position of the flow control element in the nozzle flow path to set the nozzle flow area; and the deflectable portion of the nozzle is constructed to move the flow control element to increase the nozzle flow area as the exit angle is increased relative to the horizontal, and to decrease the nozzle flow area as the exit angle is decreased relative to the horizontal.

6. A sprinkler as described in claim 5, wherein the flow control element is movable relative to the deflectable portion of the nozzle by the operation of the flow control actuator mechanism.

7. A sprinkler as described in claim 3, wherein the deflectable portion of the nozzle is constructed to pivot the flow control element as it is deflected by the range setting actuator mechanism.

8. A sprinkler according to claim 1, wherein:

the nozzle, the spray range setting mechanism, the flow control mechanism and the coupling mechanism are mounted in a nozzle housing having a top surface;

the flow control mechanism includes a rotatable member mounted in the housing, a top portion of the rotatable member is accessible through an opening in the top surface of the housing to permit manual adjustment of the flow control mechanism; and the top surface of the nozzle housing top and the top portion of the rotatable member bear cooperating indicia representing the setting of the flow control mechanism.

9. A sprinkler comprising:

a nozzle;

a nozzle drive mechanism which oscillates the nozzle through a preset arc of coverage;

an arc setting mechanism coupled to the nozzle drive mechanism that is manually adjustable to set a desired arc of coverage for the sprinkler;

a flow control mechanism that is manually adjustable to to vary the precipitation rate for the sprinkler;

a first coupling mechanism between the arc setting mechanism and the flow control mechanism which automatically adjusts the flow rate when the arc of coverage setting mechanism is adjusted to maintain a substantially constant precipitation rate independent of changes in the arc of coverage while permitting independent adjustment of the flow control mechanism without disturbing an existing arc of coverage setting.

10. A sprinkler as described in claim 9, wherein:

the arc setting mechanism is comprised of a rotatable shaft which is constructed to engage with contact members of a rotational drive mechanism to adjust the arc setting;

the flow control mechanism is comprised of:

a flow control element movable in the flow path of the nozzle; and a flow control actuator mechanism which adjusts the position of the flow control element in the nozzle flow path to set the nozzle flow area; and the coupling mechanism between the arc setting mechanism and the flow control mechanism frictionally engages the flow control actuator mechanism to move the flow control element when the rotatable shaft is rotated to change the arc setting.

11. A sprinkler as described in claim 10, wherein the flow control actuator mechanism is movable relative to the rotatable shaft of the arc setting mechanism due to slippage in the coupling mechanism between the arc setting mechanism and the flow control mechanism.

12. A sprinkler as described in claim 10, wherein the rotatable shaft, the coupling mechanism and the flow control mechanism are constructed and configured so that a first frictional force exists between the rotatable shaft and the coupling mechanism, and a second frictional force smaller than the first frictional force exists between the flow control mechanism and the coupling mechanism.

13. A sprinkler as described in claim 9, further comprising:

a spray range setting mechanism that is manually adjustable to set a desired elevation angle at which a stream of water exits from the nozzle; and a second coupling mechanism between the spray range setting mechanism and the flow control mechanism which automatically adjusts the flow rate according to changes in the spray range setting to maintain a substantially constant precipitation rate independent of changes in the spray range.

14. A sprinkler as described in claim 13, wherein the first coupling mechanism is constructed to permit slippage between the flow control mechanism and the arc setting mechanism, whereby the flow may be adjusted to establish a desired precipitation rate without disturbing a preset arc of coverage.

15. A sprinkler as described in claim 14, wherein the flow control actuator mechanism is comprised of a rotatable shaft including an axially offset pin which engages with a camming slot in the flow control element to move the flow control element linearly into and out of the nozzle flow area as the shaft is rotated.

16. A sprinkler as described in claim 15, wherein:

the deflectable portion of the nozzle is constructed to pivot the flow control element as it is deflected by the range setting actuator mechanism; and the fit of the offset pin in the camming slot is such that the flow control element is pivotable relative to the pin.

17. A sprinkler as described in claim 13, wherein the second coupling mechanism is further operative to permit adjustment of the flow control mechanism without disturbing an existing spray range setting.

18. A sprinkler as described in claim 17, wherein the second coupling mechanism is constructed to permit relative movement between the flow control mechanism and the spray range setting mechanism when the flow control mechanism is operated whereby the flow may be adjusted to change the precipitation rate without disturbing the existing spray range setting.

19. A sprinkler as described in claim 17, wherein the spray range setting mechanism is comprised of an adjustable range setting actuator mechanism coupled to a deflectable portion of the nozzle, the deflectable portion of the nozzle being constructed to set the exit angle of water flowing from the nozzle according to the adjustment of the actuator mechanism.

20. A sprinkler as described in claim 19, wherein the actuator mechanism is a rotatable threaded shaft which moves linearly to pivot the deflectable portion of the nozzle.

21. A sprinkler as described in claim 19, wherein the flow control mechanism includes a flow control element movable in the nozzle flow path, and a flow control actuator mechanism which adjusts the position of the flow control element in the nozzle flow path to set the nozzle flow area; and the deflectable portion of the nozzle is constructed to move the flow control element to increase the nozzle flow area as the exit angle is increased relative to the horizontal, and to decrease the nozzle flow area as the exit angle is decreased relative to the horizontal.

22. A sprinkler as described in claim 21, wherein the flow control element is movable relative to the deflectable portion of the nozzle by the operation of the flow control actuator mechanism.

23. A sprinkler as described in claim 19, wherein the deflectable portion of the nozzle is constructed to pivot the flow control element as it is deflected by the range setting actuator mechanism.

24. A sprinkler according to claim 9, wherein:

the nozzle, the arc setting mechanism, the flow control mechanism and the first coupling mechanism are mounted in a nozzle housing having a top surface;

the flow control mechanism includes a first rotatable member mounted in the housing;

a top portion of the first rotatable member is accessible through an opening in the top surface of the housing to permit manual adjustment of the flow control mechanism; and the top surface of the nozzle housing top and the top portion of the first rotatable member bear cooperating indicia representing the setting of the flow control mechanism.

25. A sprinkler as described in claim 24, wherein the arc setting mechanism includes a second rotatable member which extends through the housing to the top surface thereof, and is concentric with the first rotatable member, the first and second rotatable members and the top surface of the housing cooperating with each other to indicate the arc of oscillation setting, and relative flow rate for the arc of oscillation setting.

26. A sprinkler as described in claim 25, wherein the relative flow rate is indicated in terms of a precipitation rate accurate at the intended nominal water supply pressure for the nozzle.

27. A sprinkler comprising:

a nozzle;

a spray range setting mechanism that is manually adjustable to set a desired elevation angle at which a stream of water exits from the nozzle;

a flow control mechanism that is manually adjustable to vary the flow rate for the sprinkler; and a coupling mechanism between the spray range setting mechanism and the flow control mechanism which automatically adjusts the flow rate when the spray range setting mechanism is adjusted to maintain a substantially constant flow rate independent of changes in the spray elevation angle while also permitting independent adjustment of the flow control mechanism without disturbing an existing spray elevation angle setting.

28. A sprinkler as described in claim 27, wherein the coupling mechanism is constructed to permit relative movement between the flow control mechanism and the spray range setting mechanism when the flow control mechanism is operated whereby the flow may be adjusted to change the precipitation rate without disturbing the existing spray elevation angle setting.

29. A sprinkler as described in claim 27, wherein:

the nozzle, the spray range setting mechanism, the flow control mechanism and the coupling mechanism are mounted in a nozzle housing having a top surface;

the flow control mechanism includes a rotatable member mounted in the housing, a top portion of the rotatable member is accessible through an opening in the top surface of the housing to permit manual adjustment of the flow control mechanism; and the top surface of the nozzle housing top and the top portion of the rotatable member include cooperating indicia representing the setting of the flow control mechanism.

30. A sprinkler comprising:

a nozzle;

a nozzle drive mechanism which oscillates the nozzle through a preset arc of coverage;

an arc setting mechanism coupled to the nozzle drive mechanism that is manually adjustable to set a desired arc of coverage for the sprinkler;

a flow control mechanism that is manually adjustable to set a desired flow rate for the sprinkler; and a first coupling mechanism between the arc setting mechanism and the flow control mechanism which automatically adjusts the flow rate when the arc of coverage setting mechanism is adjusted to maintain a substantially constant flow rate per unit of arc of coverage independent of changes in the arc of coverage while permitting independent adjustment of the flow control mechanism without disturbing an existing arc of coverage setting.

31. A sprinkler as described in claim 30, wherein:

the arc setting mechanism includes a rotatable shaft;

the flow control mechanism is comprised of:

a flow control element movable in the flow path of the nozzle; and a flow control actuator mechanism which adjusts the position of the flow control element in the nozzle flow path to set the nozzle flow area; and the coupling mechanism between the arc setting mechanism and the flow control mechanism frictionally engages the flow control actuator mechanism to move the flow control element when the rotatable shaft is rotated to change the arc setting.

32. A sprinkler as described in claim 31, wherein the flow control actuator mechanism is movable relative to the rotatable shaft of the arc setting mechanism due to slippage in the coupling mechanism between the arc setting mechanism and the flow control mechanism.

33. A sprinkler as described in claim 31, wherein the rotatable shaft, the coupling mechanism and the flow control mechanism are constructed and configured so that a first frictional force exists between the rotatable shaft and the coupling mechanism, and a second frictional force smaller than the first frictional force exists between the flow control mechanism and the coupling mechanism.

34. A sprinkler as described in claim 30, further comprising:

a manually adjustable spray elevation angle setting mechanism operable to set a desired elevation angle at which a stream of water exits from the nozzle; and a second coupling mechanism between the spray elevation angle setting mechanism and the flow control mechanism which automatically adjusts the flow rate according to changes in the spray elevation angle setting to maintain a substantially constant precipitation rate independent of changes in the spray elevation angle.

35. A sprinkler as described in claim 34, wherein the flow control actuator mechanism is comprised of a rotatable shaft including an axially offset pin which engages with a camming slot in the flow control element to move the flow control element linearly into and out of the nozzle flow area as the shaft is rotated.

36. A sprinkler as described in claim 35, wherein:

the deflectable portion of the nozzle is constructed to pivot the flow control element as it is deflected by the range setting actuator mechanism; and the fit of the offset pin in the camming slot is such that the flow control element is pivotable relative to the pin.

37. A sprinkler as described in claim 34, wherein the second coupling mechanism is further operative to permit adjustment of the flow control mechanism without disturbing an existing spray elevation angle setting.

38. A sprinkler as described in claim 37, wherein the second coupling mechanism is constructed to permit relative movement between the flow control mechanism and the spray elevation angle setting mechanism when the flow control mechanism is operated whereby the flow may be adjusted to change the precipitation rate without disturbing the existing spray elevation angle setting.

39. A sprinkler according to claim 30, wherein:

the nozzle, the arc setting mechanism, the flow control mechanism and the coupling mechanism are mounted in a nozzle housing having a top surface;

the flow control mechanism includes a rotatable member mounted in the housing;

a top portion of the rotatable member is accessible through an opening in the top surface of the housing to permit manual adjustment of the flow control mechanism; and the top surface of the nozzle housing top and the top portion of the rotatable member bear cooperating indicia representing the setting of the flow control mechanism.

40. A sprinkler as described in claim 39, wherein the arc setting mechanism includes a second rotatable member which extends through the housing to the top surface thereof, and is concentric with the first rotatable member, the first and second rotatable members and the top surface of the housing cooperating with each other to indicate the arc of oscillation setting, and relative flow rate for the arc of oscillation setting.

41. A sprinkler as described in claim 40, wherein the relative flow rate is indicated in terms of a precipitation rate accurate at the intended nominal water supply pressure for the nozzle.

* * * * *